US007588474B2

(12) United States Patent
Taggart

(10) Patent No.: US 7,588,474 B2
(45) Date of Patent: Sep. 15, 2009

(54) AUTOMATIC DISCONNECT FOR RIVERBOARD PROPULSION SYSTEM

(76) Inventor: William Taggart, 945 W. Broadway, Jackson, WY (US) 83001

( * ) Notice: Subject to any disclaimer, the term of this patent is extended or adjusted under 35 U.S.C. 154(b) by 15 days.

(21) Appl. No.: 11/776,015

(22) Filed: Jul. 11, 2007

(65) Prior Publication Data

US 2009/0004937 A1 Jan. 1, 2009

Related U.S. Application Data

(60) Provisional application No. 60/807,334, filed on Jul. 13, 2006.

(51) Int. Cl.
*B63B 1/00* (2006.01)

(52) U.S. Cl. ..... 441/65; 114/253

(58) Field of Classification Search ..... 114/253; 441/65, 68, 69, 74
See application file for complete search history.

(56) References Cited

U.S. PATENT DOCUMENTS 3,027,574 A 4/1962 Meehan
3,340,554 A * 9/1967 Allender ..... 441/65
3,380,425 A * 4/1968 Wilson ..... 114/253
3,422,786 A * 1/1969 Brandhorst ..... 114/253
4,069,786 A 1/1978 La Botz
4,986,784 A * 1/1991 French ..... 441/65
4,989,531 A * 2/1991 Humphrey ..... 441/65
5,083,955 A 1/1992 Echols
5,154,655 A * 10/1992 Glydon ..... 441/65
5,462,001 A * 10/1995 Lemelson ..... 114/253
6,938,554 B2 9/2005 Aaltonen et al.
7,025,644 B2 * 4/2006 Geier et al. ..... 441/74

* cited by examiner

*Primary Examiner*—Lars A Olson
(74) *Attorney, Agent, or Firm*—Your Intellectual Property Matters, LLC; Robert A. Frohwerk

(57) ABSTRACT

This apparatus provides an automatic release of a resilient buoyant tether from a water-skimming board device. In use, a tether (100) is attached to a waterboard (50) at one end and secured to an anchor (30) at the other. By maneuvering the board, a rider (20) first stretches the tether and then releases the force stored in the stretched tether to propel the board (50) with rider over the water at high speed. As the board approaches the anchor point (30), the tether (100) automatically releases to reduce drag for an unencumbered ride. When used on a river, the described hook (140) and loop (120) apparatus is easily retrieved by the rider and reconnected to the board (50) in preparation for the next ride. Safety features ensure protection of the rider and of observers. The coupling mechanism may be built in to new water boards or retrofitted to others.

3 Claims, 9 Drawing Sheets

AUTOMATIC DISCONNECT FOR RIVERBOARD PROPULSION SYSTEM

CROSS-REFERENCES TO RELATED APPLICATIONS

This application claims benefit of U.S. Provisional Application No. 60/807,334, filed Jul. 13, 2006, entitled "Automatic Disconnect for Riverboard Propulsion System", which is incorporated here by reference in its entirety.

This application is related to U.S. Pat. No. 7,025,644 filed May 24, 2004 and issued Apr. 11, 2006, titled "High-performance riverboard system," which is commonly assigned, the entire contents of which are incorporated herein by reference.

STATEMENT REGARDING FEDERALLY SPONSORED RESEARCH OR DEVELOPMENT

Not Applicable.

FIELD OF THE INVENTION

The present invention relates generally to a towing mechanism for a personal watercraft. More particularly, the described device provides a means for automatically releasing from a riverboard the cable of a propulsion system after its purpose has been achieved, and further enables quick reattachment of the cable to the riverboard.

BACKGROUND OF THE INVENTION

In U.S. Pat. No. 7,025,644 titled "High-performance riverboard system" inventors Geier and Veon described enhancements to what had previously been an informal sport, bringing it to levels of performance previously unachievable. In the targeted water sport system the user is enabled to maneuver a riverboard on the surface of flowing water. A special propulsion subsystem in the form of a resilient tether selected for its extreme elongation is used to secure the riverboard to an anchor.

To use the riverboard system, a rider moves the attached riverboard downstream from the anchor until all slack is removed from the tethering subsystem and then mounts the riverboard assuming a choice of standing, kneeling or prone positions. The weight of the rider keeps the riverboard in the water as the resistance of the riverboard against the water flow causes the tethering subsystem to become taut. As the rider shifts weight toward the rear of the riverboard, its front is uplifted, dropping its rear deeper into the water so as to present a greater drag that causes the elastic tether of the propulsion subsystem to stretch. When the rider then shifts weight by leaning forward, the drag of the riverboard against the water is reduced and the resilience of the propulsion subsystem attempts to restore the tether to its static, unstretched condition. This propels the riverboard toward the anchor. To assist a rider to remain in contact with the riverboard during a high-speed upstream ride, previous embodiments provided for a handle, similar to a ski tow rope, attached to a point in the front portion of the riverboard. Alternate embodiments of the riverboard allowed for various bindings to assist the rider to maintain a foothold.

With experience, riders of a high-performance riverboard system often choose not to use any form of handle or binding in order that they may be free to execute the freestyle maneuvers more commonly associated with surfing, snowboarding or skateboarding. To such experienced riders the attachment of the tether to their riverboard becomes an additional inconvenient and undesirable limitation. A first consideration is that as the riverboard approaches the upstream anchor point, that tether becomes slack and introduces some drag in the water that reduces performance resulting in a shortening of the duration of the ride. A second consideration is that the performance of the propulsion system is such that the rider and riverboard may be propelled upstream to a distance beyond the anchor that is greater than the length of the unstretched tether. For at least these two reasons, it would be advantageous for a rider to be able to disconnect the tether from the riverboard at that time during a particular ride when it is no longer desired for propulsion. Furthermore, it is preferred that the tether automatically disconnect itself from the riverboard after it has served its purpose. Additionally, a convenient method of reattachment is desirable, as are safety precautions associated with an unconnected tether that is lying at or just below the surface of the water.

These and various other novel features and advantages of the present invention will be readily understood by those skilled in the related arts with reference to the following detailed description taken in conjunction with the accompanying drawings.

BRIEF SUMMARY OF THE INVENTION

The disclosed invention is primarily intended as part of a water sport system as it relates to a device that enables automatic disconnection and easy reconnection of a riverboard to its tether line. In one configuration a loop is formed at the end of the tether where it may be connected to a hook on the underside of a riverboard. In an alternate configuration the tether terminates in a hook that may be captured into a tapered hole on the underside of a riverboard. In either situation the shape of the hook and/or hole is critical in order to achieve proper connect and disconnect operations.

The angle presented by the hook to its mating counterpart is such that the connection between them is maintained when the riverboard is in a nearly vertical, nose in the air, orientation. At the other extreme the hook is sufficiently open to facilitate disconnection of the coupling without rider intervention when the tether goes slack. For reconnection, the unconnected end of the tether floats and is easily discovered in the water. The mating portion of the connector accommodates reconnection by a rider who is operating blindly from the opposite surface of the riverboard while floating in the water. All hooks are appropriately recessed or shrouded so as to avoid injury to the rider and to observers.

The portion of the connector at the riverboard, whether it be a hook or a hole, may be built into the board at the time of its manufacture. If so, it will be located in a reinforced block in order to avoid pullout under the extreme loads presented by the stretched tether. Aftermarket retrofit of other riverboards is accommodated by a block that may be inserted into an owner-bored hole and installed with reinforcement plates to avoid tearout under load. Alternately, riverboards with sufficient structural integrity may be adapted to receive a special hook into an owner-drilled and tapered hole.

BRIEF DESCRIPTION OF THE DRAWINGS

The particular features and advantages of the invention briefly described above as well as other objects will become apparent from the following description taken in conjunction with the accompanying drawings, in which:

FIG. 13 shows side views of an alternate embodiment having a hook at the end of the tether, where

Figure 1:
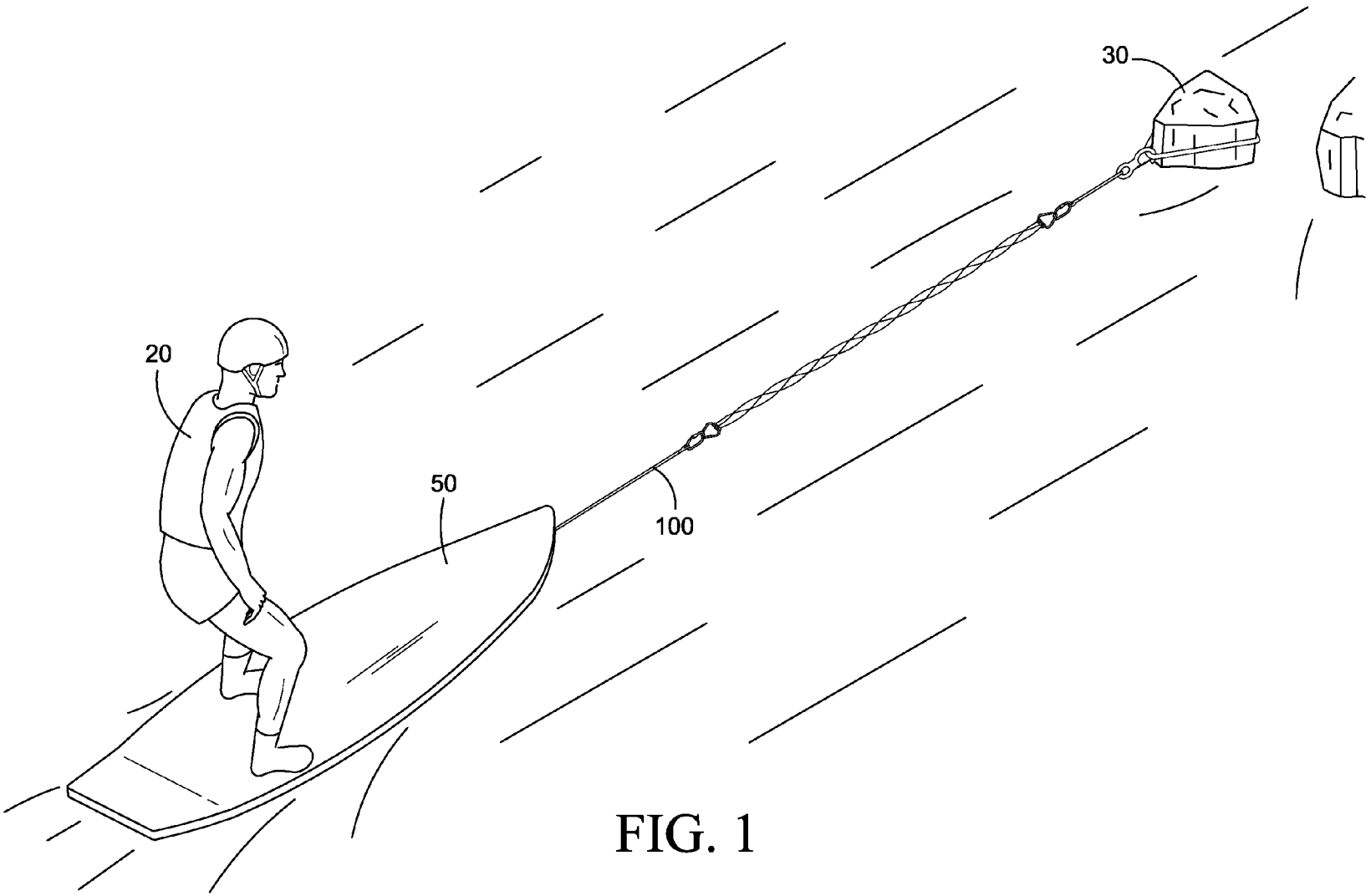
FIG. 1 shows a rider on a riverboard that is connected at its underside by the present invention to a tether.

The following Reference Numbers will be used in conjunction with the accompanying figures:

20. rider
30. anchor
50. riverboard
56. nose of riverboard 50
100. tether
120. loop at end of tether 100
122. wire loop
124. connective device that is releasable, such as a carabiner
130. handle
132. connector end of handle 130
134. tether end of handle 130
136. outer surface of handle 130
140. hook at underside of riverboard 50
142. hook, alternate embodiment, formed into underside of riverboard 50
144. hook, shaped steel
146. slotted nut
148. hook, alternate embodiment
150. reinforcing block
152. ramp
154. rod
156. recess in underside of riverboard 50
180. hole, tapered

DETAILED DESCRIPTION OF THE INVENTION

Figure 2:
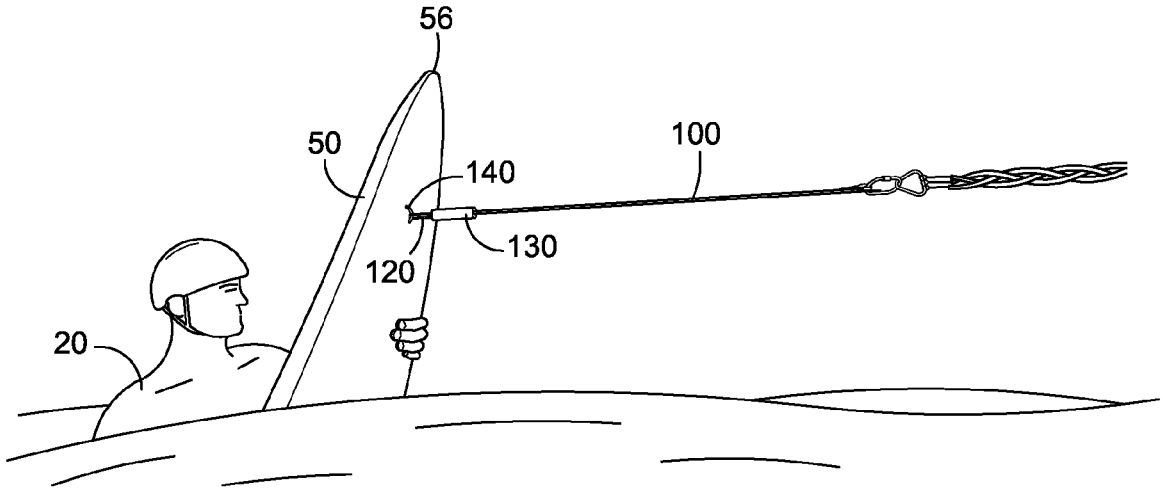
FIG. 2 shows the present invention with the riverboard in a near vertical orientation as the tether is being stretched against flowing water.

Riders of a high-performance riverboard system such as that described in U.S. Pat. No. 7,025,644 are able to achieve greater performance with an automatically disconnectable propulsion system. Referring to FIG. 1, it will be seen that in the previously described riverboard system a resilient tether 100 capable of extreme elongation serves both to secure the riverboard 50 to an anchor 30 and to act as a special propulsion subsystem. After securing one end of the tether to an anchor point and the other end to the underside of the riverboard, a user 20 jumps into flowing water such as that of a river and drifts downstream until the slack is removed from the tether 100. By shifting weight to the rear of the riverboard, the nose 56 or front of the board tilts upward toward a near vertical orientation (as shown in FIG. 2) presenting greater drag against the water which causes the tether to stretch. After stretching the tether to a suitable elongation, the rider then shifts weight toward the front of the riverboard dropping the nose 56 of the board into a position that allows it to plane on the water. With the decreased resistance in this orientation the tether contracts propelling the riverboard and its rider upstream.

Up to this point in the ride cycle there is no reason that the riverboard should not be permanently connected to the tether. However, as the riverboard and rider progress upstream to the point where the tether returns to its unstretched length and then becomes slack, the tether, having served its purpose for propulsion, is no longer needed. As the riverboard ride progresses beyond this point an attached tether becomes a drag which decreases performance. Furthermore, an extended ride on such a high-performance system may easily send the board and rider some distance upstream of the anchor point in excess of the length of an unstretched tether. It is therefore an advantage to release the tether from the riverboard at some point prior to this so as not to degrade the performance of the system from its potential. Due to the considerable speed, 20 to 30 mph, that is achievable in the high-performance riverboard system, it is desirable not only for convenience but also for safety purposes that disconnection of the tether from the riverboard be automatic, requiring no user intervention.

In FIG. 1 a rider 20 is depicted in a riding stance on a riverboard 50 with the present invention connecting a tether 100 to the underside of the riverboard 50. The close-up view in FIG. 2 shows the connection of a loop 120 at the end of the tether 100 to a hook 140 at the underside of the board 50. In this figure the riverboard is in a near vertical orientation as if the rider was located at the rear in order to stretch the tether, charging the propulsion system against the flowing water. It is important that the hook has sufficient extent that the loop does not become disconnected when in this orientation. Each of the components of the connection system must have sufficient strength to hold up against the considerable forces encountered while stretching the tether.

Figure 3:
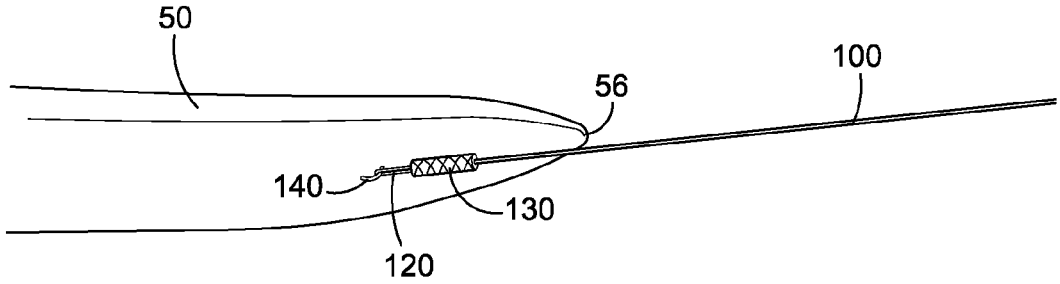
FIG. 3 shows the tether connected to the riverboard in the riding position.
Figure 4:
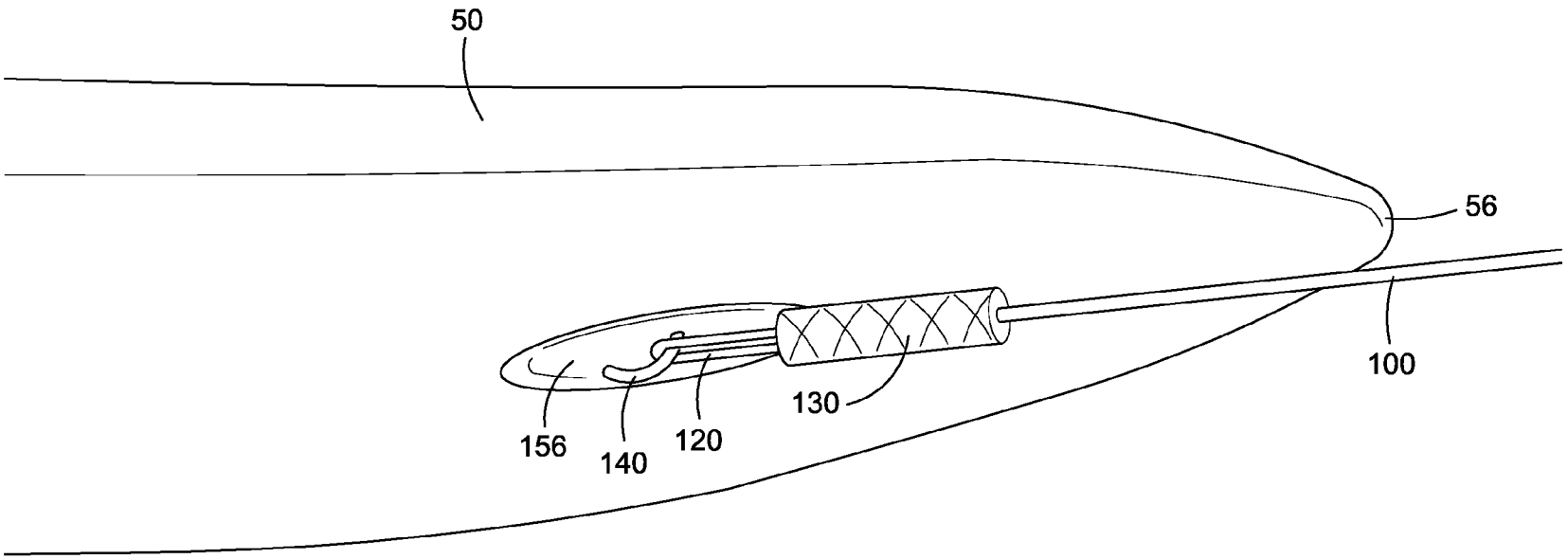
FIG. 4 is a close-up of an embodiment of the present invention showing the components of the connector system.

After the tether 100 has been suitably stretched, the rider 20 shifts weight toward the front of the riverboard dropping it into a relatively horizontal orientation as shown in FIG. 3, with a close-up view in FIG. 4. In this orientation the riverboard planes upon the surface of the water during the upstream portion of the ride. This orientation places a few restrictions upon the connection. It must be located near the front of the board so as to avoid instability as the board is drawn over the water. The connection must also be sufficiently flexible in order to allow relatively unrestricted motion with regard to pitch, roll, and yaw. Since the connection point between the riverboard 50 and the tether 100 is near the nose 56 of the board, and the planing phase of the ride is relatively frictionless, the board will generally travel upstream toward the anchor point as long as there is tension in the tether 100. An exception, of course, will occur for a rider who is executing extreme maneuvers, in which case there need be no guarantee that the connection will remain intact.

The connection between the tether 100 and the riverboard 50 that is provided by the present invention will automatically release as the attached riverboard 50 proceeds toward the anchor 30 beyond the point at which the tether 100 goes slack. With reduced load on the connection, the loop 120 easily falls away from the hook 140 as the riverboard 50 with attached hook 140 continues to fly upstream. If for some reason the loop 120 does not fall freely from the hook 140, its release will be assisted by continued upstream travel of the riverboard 50 which will carry the hook 140 to such point that the loop 120 will be flipped by the drag of its tether 100 in the water pulling the loop 120 from the hook 140.

With the riverboard 50 now disconnected from the tether 100, the rider 20 is free to maneuver without impediment to the extremes allowed by speed and skill, even to the extent of executing flips if desired. Eventually all good things must end, the riverboard 50 and rider 20 will return to the water and drag will carry them both downstream. Generally, the rider 20 will lie prone on the riverboard 50 as it drifts downstream allowing it to be maneuvered by paddling with the arms and kicking the feet. In this final phase of the ride it is important that the connector at the end of the tether 100 be retrievable as the would-be rider 20 seeks to locate it and to reattach it to the hook 140 on the underside of the board 50. Various safety features are incorporated into the present invention to assist the rider in this process while minimizing the dangers of entanglement in the tether and snagging on the connector system.

Figure 5:
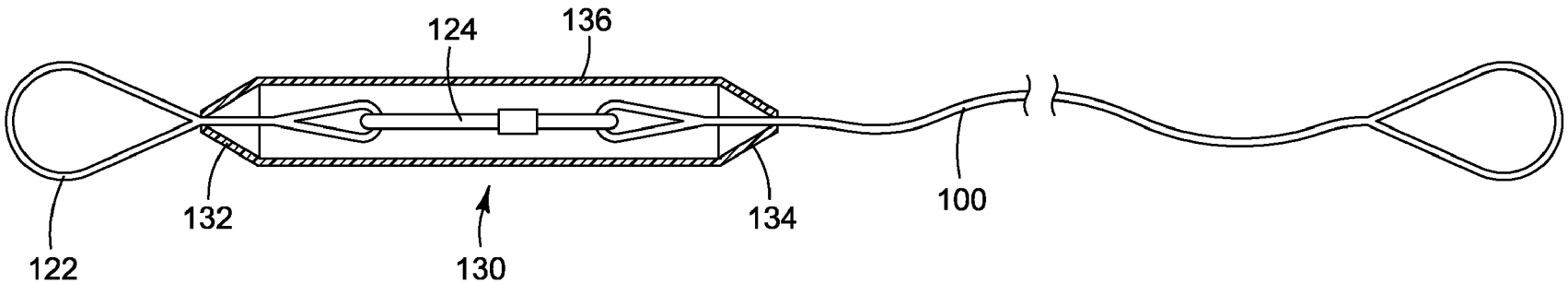
FIG. 5 is an enlarged view detailing the preferred embodiment of a loop portion of the connection subsystem at the end of a tether.
Figure 6:
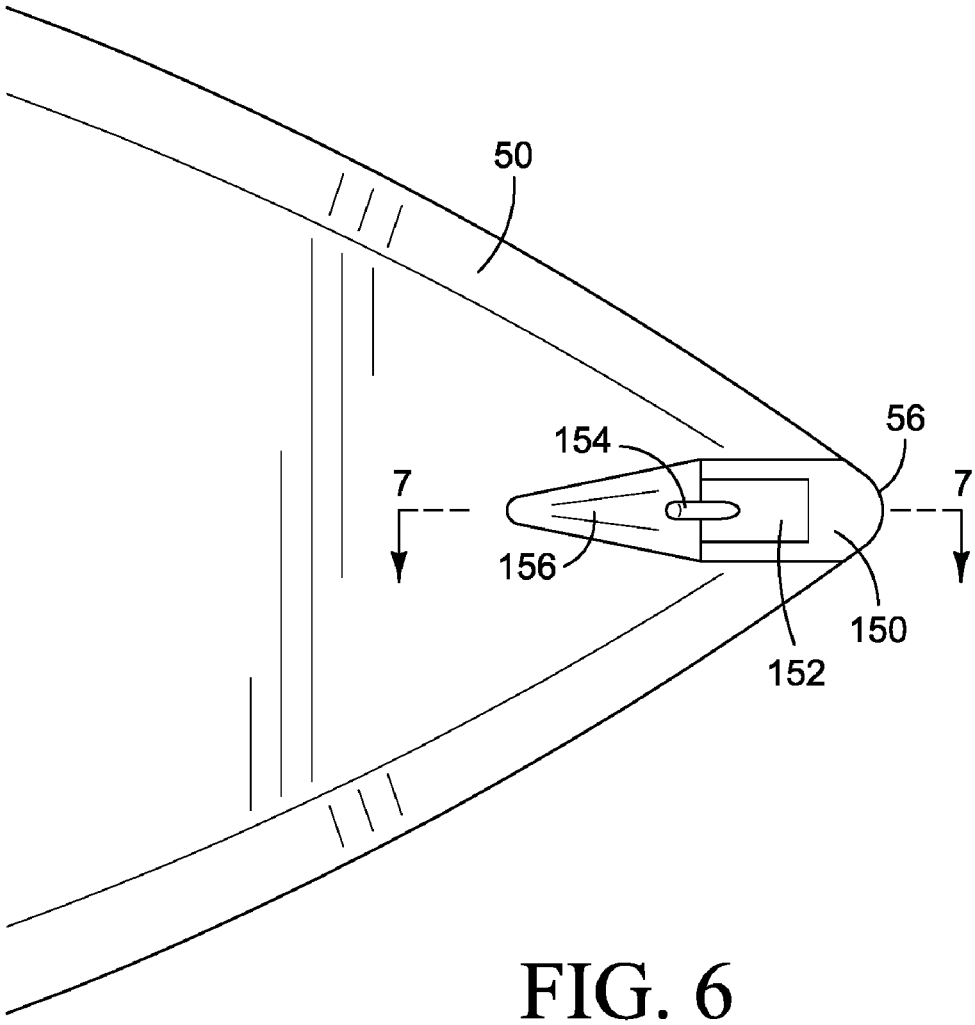
FIG. 6 shows a top view of the preferred embodiment of a hook portion of the connection subsystem built into a riverboard.
Figure 7:
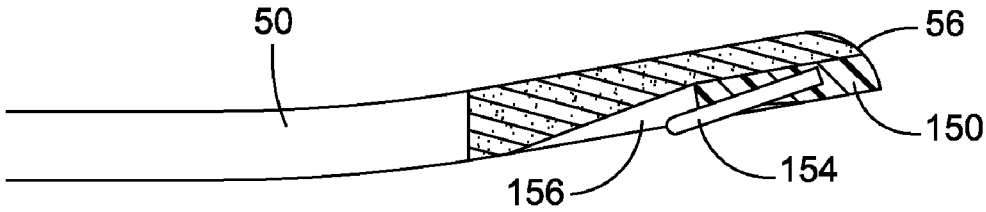
FIG. 7 is a cross-section of the hook portion of the connection subsystem of the preferred embodiment.
Figure 8:
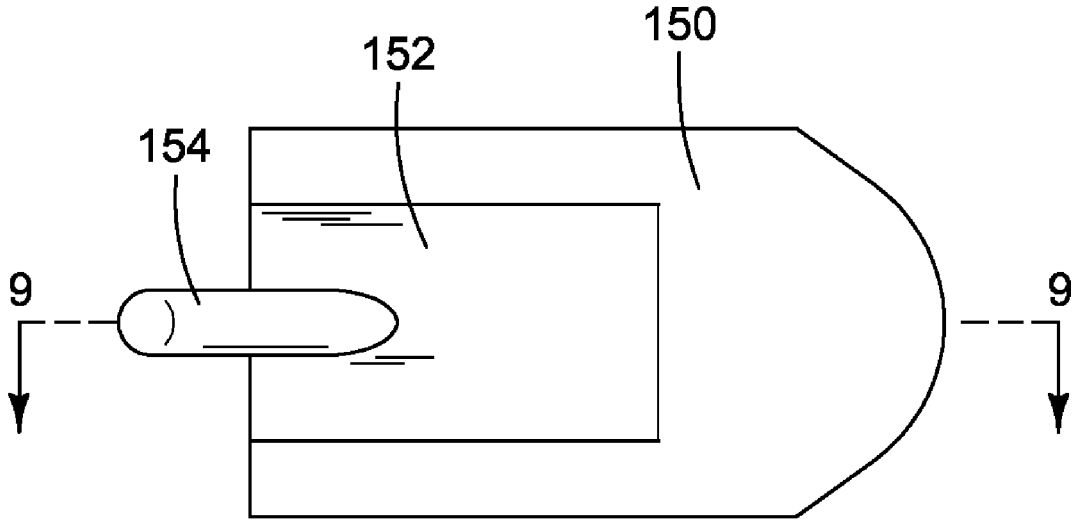
FIG. 8 identifies in a bottom view the components of the hook portion of the connection subsystem of the preferred embodiment.
Figure 9:
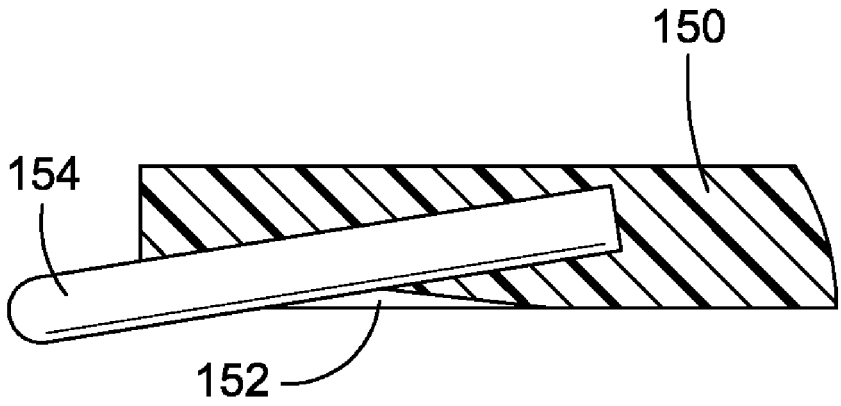
FIG. 9 is a cross-section of the hook of the preferred embodiment.

The components of the loop 120 in the preferred embodiment of the present invention are shown in FIG. 5. Here it can be seen how the wire loop 122 is preferably attached to the end of the tether 100. The wire loop 122 is stainless steel so as to avoid corrosion and is preferably coated with a plastic sheath to reduce friction in its connection to the hook 140. Wire sized at about 8-gauge (roughly ⅛-inch diameter) is used to provide a sufficient load-rating. To facilitate repair as well as manufacture, the wire loop 122 is connected to the end of the tether 100 by a connective device that is releasable, such as a carabiner 124. A tubular handle 130 having a length of approximately 8 inches covers a portion of the stainless steel wire loop 122, the connective device 124, and a portion of the end of the tether 100. Approximately a 2 inch length of the wire loop 122 protrudes from the connector end 132 of the handle 130 in a rigid mount, whereas the tether at the other end 134 of the handle 130 may be relatively flexible or stiffened. The outer surface 136 of the handle 130 is embossed or textured to provide a good handgrip especially when it is wet. The tubular handle 130 is constructed to provide flotation, whether by use of an air pocket, a plastic foam fill or other means, so that it will remain close to the surface of the water when drifting unattended. The tubular handle 130 is brightly colored (preferably yellow) so as to be easily visible to those in the water as well as to shoreline observers.

As the riverboard floats downstream, its rider finds the brightly colored handle floating near the surface of the water at the end of the tether and maneuvers into position to retrieve it. With a secure grip on the handle, the board and rider are prevented from drifting further downstream than what is allowed by a small stretch of the tether system. The rider is easily able to reach around the riverboard and to twist the rigid end of the handle to reconnect the wire loop to the hook at the underside of the riverboard. With the connection thus easily made, the board and its user are ready to begin the next ride.

The embodiment shown in FIGS. 2-4 comprises a hook 140 mounted into the body of the riverboard 50 and a loop 120 constructed as an integral part of the tether 100 at the end of the propulsion system. The close-up views of FIGS. 6-9 show the construction of the preferred embodiment of the hook 140 assembly. A block of rigid ABS plastic 150 is molded into the nose 56 of the riverboard 50 to provide support for the hook 140. A recess 156 is cut into the underside of the riverboard 50 aft of the ABS reinforcing block 150 to facilitate the location of the hook 140 and connection to it of the loop 120 by a rider who will be operating blindly from the opposite side of the riverboard 50 when in the water.

The connective portion of the hook 140 is a straight stainless steel rod 154 that has had most of its length inserted into the reinforcing block 150. The rod 154 has a diameter of about ¼" and protrudes approximately ½" out of the ABS block 150 into the recessed area 156 of the riverboard 50. A ramp 152 is cut into the reinforcing block 150 near the protruding steel rod 154 to provide relief for the loop 120 when it is connected to the hook 140 when the riverboard 50 is oriented in the planing position. Not only does this ramp 152 eliminate some of the wear that would otherwise occur through use of the connector system, it also facilitates the automatic release of the loop 120 from the hook 140.

Figure 10:
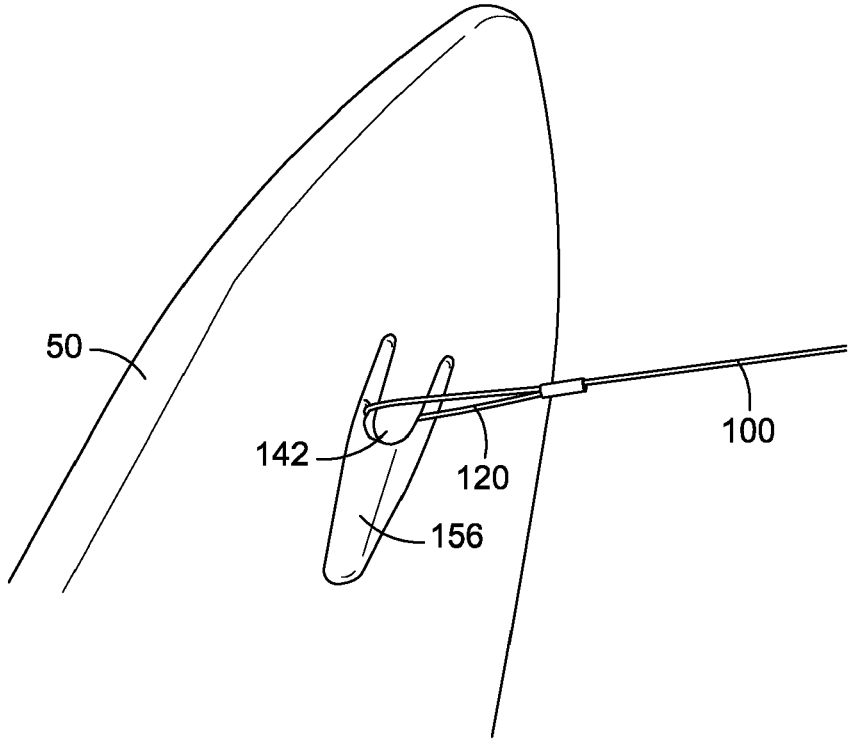
FIG. 10 depicts an alternate embodiment oriented similar to that of FIG. 2.
Figure 11:
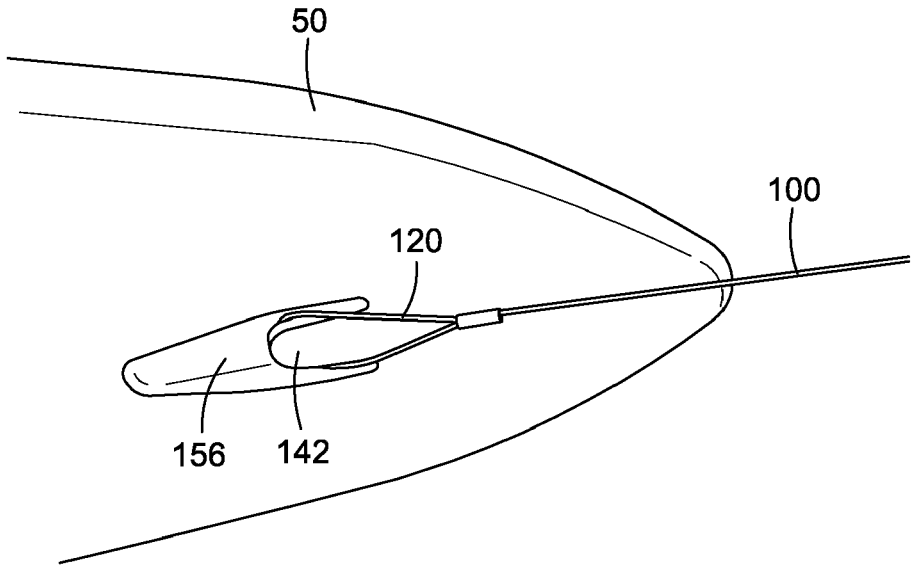
FIG. 11 shows the alternate embodiment of FIG. 10 in the riding orientation as that of FIG. 3.

One alternate embodiment of a hook 142 in the present invention is shown in FIGS. 10-11. This embodiment is adequate for waterboards that will not be subjected to the severe loads of a high performance riverboard system. Here the hook 142 is formed directly into the underside of the waterboard. This requires that the board have extra thickness to accommodate the necessary relief while leaving sufficient material to shape the tongue of the wider hook 142. It is to be noted that this format presents considerably more friction than that of the preferred embodiment and will result in a slower automatic release.

Figure 12:
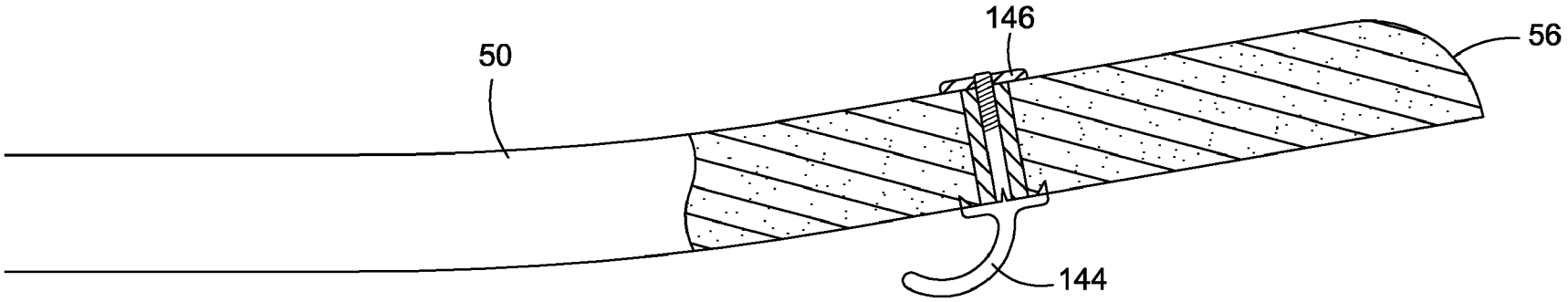
FIG. 12 is a side view of an alternate embodiment suitable for retrofitting in an aftermarket installation.

Another alternate embodiment suitable for retrofit in the aftermarket to previously manufactured riverboards is shown in FIG. 12. Here, an appropriately shaped steel hook 144 is inserted through the board 50 and threadably captured to be held in place by a retainer 160 attached from the upper side of the board 50. One possible combination of hardware for use in this configuration includes a slotted nut (146) serving as a suitable retainer for a spurred-flange hook (144), where the spurred flanges act to prevent rotation of the hook. This system accommodates installation with relatively few tools. In its simplest form a small diameter hole is drilled through the board 50 for insertion of the hook 144. The threaded end of the hook 144 is pressed through the hole from the underside of the board 50 and the retainer 146 is threaded onto it at the top side of the board 50. For a flush mount, the threaded retainer 146 may be inset into the upper side of the board 50 by boring a sufficiently larger diameter relief. Depending upon the board material and the loads that will be encountered, various other hardware may be used. Those skilled in the art will recognize that the hook itself may be shaped or various flanges and locking mechanisms other than those mentioned here may be included so as to avoid pullout, tilting or rotation of the hook 144 that could cause a premature disconnect from the loop 120.

Figure 13A:
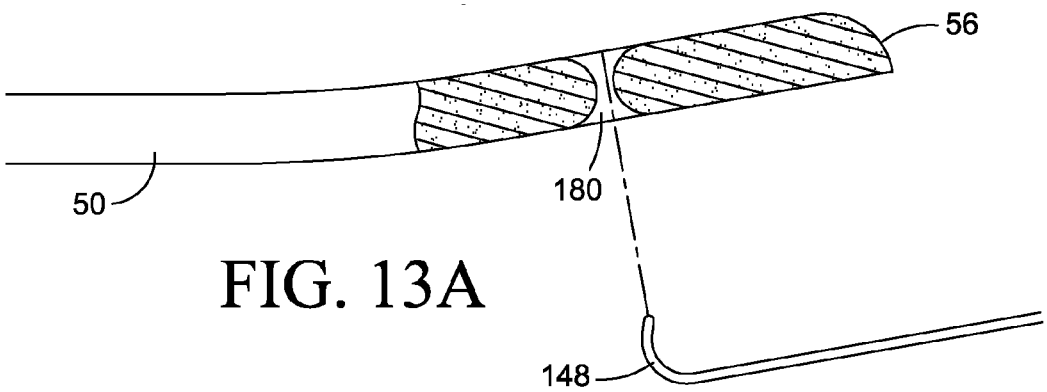
FIG. 13A shows the hooked end prior to engagement with a hole in the riverboard.
Figure 13B:
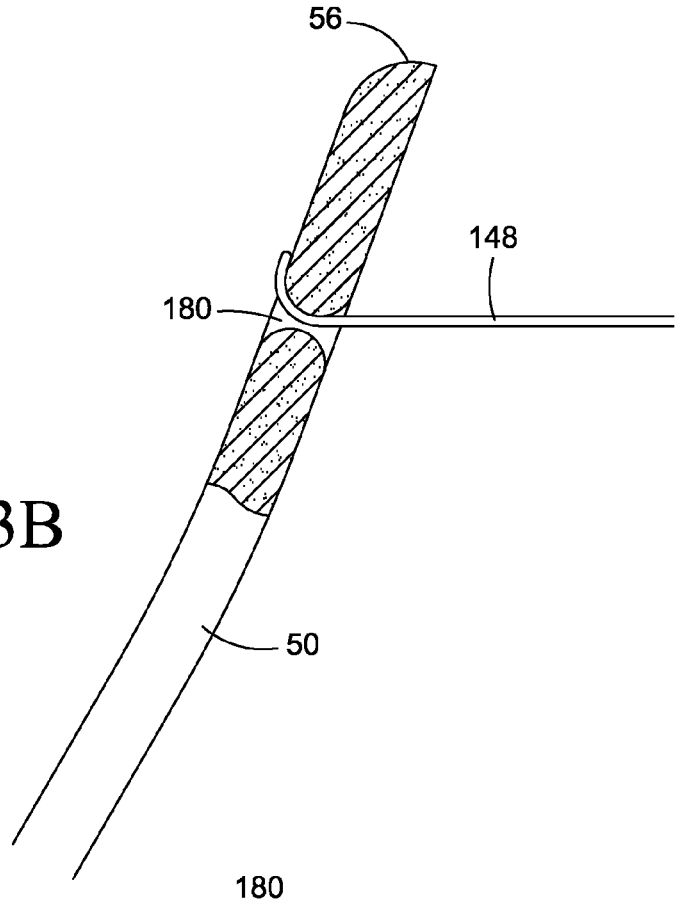
FIG. 13B is a view with the riverboard in the vertical orientation to stretch the tether.
Figure 13C:
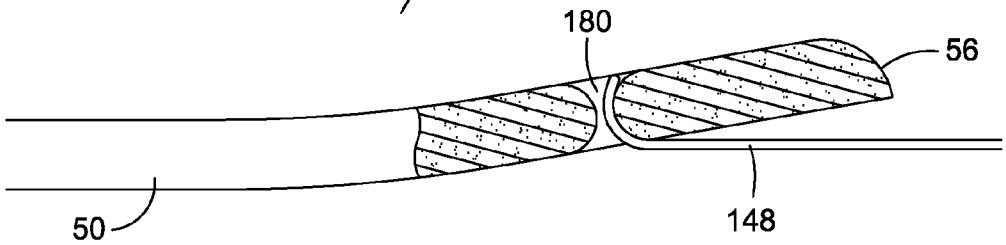
FIG. 13C shows the hook fully engaged in the hole in the riverboard as it would be during a ride.

Yet another alternate embodiment, shown in FIG. 13, includes a tether 100 that terminates in a hook 148 to be captured into a tapered hole 180 on the underside of a riverboard 50. In this case the shape of the hole 180 becomes critical in order to achieve a sufficiently strong connection over the range of angles needed to stretch the tether 100 and then plane along the surface of the water until the hook 148 disconnects. Depending upon the thickness of the board and the material from which is constructed, this embodiment will generally require reinforcement around the hole 180. This is easily achieved by forming a properly shaped hole in a plug made of a metal or ABS plastic. The board 50 is then bored to receive the plug which will be held securely in place by some combination of adhesives, flanges, pins, reinforcement plates, etc.

The hook 148 itself cannot be very aggressive, being limited to angles in the range of 75 to 90°, in order that it not become too firmly attached to the hole 180 in the board 50. The hole 180 must be shaped to allow rotation of the hook 148 through the various orientations of the riverboard 50, and sufficiently large that the hook 148 will simply drop out when tension is relieved from the tether 100. When the hook 148 in this embodiment is not connected to the riverboard 50, it will be floating freely in the water at the end of the tether 100. This requires that the hook 148 be suitably shrouded so as to avoid injury to the rider 20 and to observers; for instance the rider 20 must be able to locate the end of the freely floating tether 100 in the water, grasp it and properly orient it to fit into the hole 180 in the board 50. A brightly colored handle 130 (not shown here but similar to that described above with a loop at the end of the tether) made of a material that will float keeps the hook 148 and tether 100 near the surface of the water. A handle shaped as a pistol grip, for instance, provides the user with sufficient tactile information to properly orient the hook 148 without actually being able to see it. A compressible foam sleeve between the handle 130 and the end of the hook 148 provides protection against inadvertently being snagged by the hook 148.

The disclosed invention has been described for use with a high performance riverboard system for use on flowing water. It will be recognized that the same form of connective system can be used with devices other than riverboards to provide for automatic disconnects. Also, the techniques taught here may be applied to assist a user to make connections to other devices where visibility is limited.

The description here of alternate embodiments of an automatically disconnectable tether for a riverboard sport system is in no way intended to suggest that these are the only embodiments available. Now that the invention has been described, it will be apparent to those of ordinary skill in the many related arts that various combinations of the methods and configurations described here can be implemented in keeping with the intent of the disclosed invention and may have particular utility in other applications without departing from the spirit and scope of the invention as will be represented in the claims. Furthermore, the individual subsystems described for use in this particular form of water sport are not meant to limit in any manner the application of those subsystems to other fields of art.

What is claimed is:

1. In combination with a riverboard system for use on water flowing with respect to an anchor in which a buoyant board member is tethered to the anchor by an elongated resilient tether member, an automatically releasable connection device connecting the tether member to the board member, the connection device comprising: a hook, and one of a loop or an aperture, wherein the hook is an element at an underside of the board member, and wherein the hook is shaped so as to engage a loop at an end of the tether member proximal to the board member, and wherein the hook comprises a shaped steel hook threadably captured by a retainer attached from an upper side of the board member.

2. The connection device of claim 1, wherein the hook is a spurred-flange hook.

3. The connection device of claim 1, wherein the retainer is a slotted nut.

* * * * *